United States Patent [19]

Case

[11] 4,176,714

[45] Dec. 4, 1979

[54] SHOCK ABSORBER FOR OIL WELL PUMPING UNIT

[75] Inventor: Richard W. Case, Tulsa, Okla.

[73] Assignee: K-Shox, Inc., Tulsa, Okla.

[21] Appl. No.: 915,594

[22] Filed: Jun. 15, 1978

[51] Int. Cl.[2] ..... E21B 43/00; F16F 1/34; F16F 1/36; F16F 3/08

[52] U.S. Cl. ..... 166/72; 74/581; 166/75 R; 267/153

[58] Field of Search ..... 166/75 R, 68, 77, 84, 166/72; 267/141, 153; 74/581, 582; 248/15, 18

[56] References Cited

U.S. PATENT DOCUMENTS

| | | | |
|---|---|---|---|
| 2,038,527 | 4/1936 | Eaton | 74/582 |
| 2,230,029 | 1/1941 | Eaton | 74/582 |
| 2,241,409 | 5/1941 | Mason | 74/582 |
| 2,925,266 | 2/1960 | McAllister | 267/70 |
| 3,288,455 | 11/1966 | Robinson | 267/137 |
| 3,363,475 | 1/1968 | Foster et al. | 74/103 |
| 3,376,031 | 4/1968 | Lee | 267/63 R X |
| 3,404,877 | 10/1968 | Darnell | 267/137 |
| 3,515,382 | 6/1970 | Gallagher | 267/153 X |
| 3,993,295 | 11/1976 | Suzuki et al. | 267/153 X |

*Primary Examiner*—Stephen J. Novosad
*Attorney, Agent, or Firm*—Head, Johnson & Chafin

[57] ABSTRACT

A shock absorber for use to interconnect the polish rod of an oil well with the pumping unit in which the pumping unit includes a hanger bar having an opening therein receiving the polish rod, the shock absorber employing a tubular body axially receiving the polish rod, the body being supported on the hanger bar, and the body including a plurality of discs of elastomeric material, each having openings therein, and including a top plate secured to the polish rod with a polish rod clamp so that on up stroke of the pumping unit the elastomeric members are pressed and the openings therein form an air cushion to assist in alleviating shock transition from the polish rod to the pumping unit.

2 Claims, 6 Drawing Figures

SHOCK ABSORBER FOR OIL WELL PUMPING UNIT

BACKGROUND AND OBJECTS OF THE INVENTION

Much of the oil produced in the United States and throughout the world is by pumping wells. Normally when an oil well is first drilled into a subterranean producing formation sufficient gas pressure in the formation exists to force the oil to the earth's surface. However, as the formation pressure diminishes, it is necessary to install a pump. The most common type of oil well pump utilizes a string of sucker rods which extend from the earth's surface to the pump at the bottom of the well. At the earth's surface, a pumping unit is employed to impart reciprocal motion to the sucker rods. At the upper end of the sucker rod, a stuffing box is utilized to permit reciprocation of the sucker rod, but nevertheless confines the produced petroleum to a collecting pipe. In order to seal around the sucker rods, the upper end is connected with a rod having a smooth exterior surface which is customarily referred as a "polish rod". Thus, the pumping unit imparts reciprocal energy to the polish rod which is connected at the lower end to the sucker rod, and the sucker rods impart this reciprocal energy to the pump in the well to raise fluid in the well to the earth's surface.

Many wells require that the pump be located extremely deep in the earth, and the location of pumps more than one mile deep is not uncommon. This requires a long vertical string of sucker rods and requires the pumping unit to exert substantial lifting forces to raise the sucker rods, the pump at the bottom of the well, and the column of fluid which is being raised to the earth's surface on each upward stroke of the pumping unit. Because of the length of the sucker rod string, standing force waves can develop in the rod string. In addition, the contact of the rod string with the inside of well tubing and the opening and closing of pump valves results in an uneven load as the string of sucker rods and pumps are lifted vertically on each reciprocal stroke of the pumping unit. This uneven load can result in high load peaks, and when coupled directly to the pumping unit results in shock loads which are delivered to the various components making up the pumping unit. A typical pumping unit includes a prime mover and gears connecting the rotary motion from the prime mover to a crank arm which in turn is connected to a walking beam. These shock loads can cause accelerated wear and damage to the pumping unit gear train, bearings, the prime mover, and so forth. The present invention is directed toward a means of providing a method of interconnecting the polish rod of a well with the pumping unit so that the lifting force provided by the pumping unit to the polish rod is transmitted in a way such as to diminish transient shock leads from the polish rod to the pumping unit and thereby provide a more even load on the pumping unit.

It is therefore an object of this invention to provide a device for interconnecting the lifting load from a pumping unit to a polish rod which decreases the transmission of shock loads between these two components.

A specific object of the invention is to provide a shock absorber for use on an oil well pumping unit and polish rod including elastomeric rings for absorbing the shock load between the two, and wherein the rings include openings therethrough arranged so that air is trapped in the opening and so that as the elastomeric members are compressed by increasing loads, the air trapped in the openings is compressed providing an air cushion in addition to the elastomeric cushion to achieve an improved shock absorber.

These objects, as well as other and more specific objects of the invention, will be fulfilled in the apparatus described in the attached specification and illustrated in the drawings.

SUMMARY OF THE INVENTION

A shock absorber for use with an oil well pumping unit is provided in which the pumping unit has a horizontal hanger bar suspended by cables. The hanger bar is vertically reciprocated by the pumping unit. A vertical polish rod having the lower end secured to a string of sucker rods is utilized for actuation of a pump in a well borehole. The hanger bar has an opening therein which slidably receives the polish rod. A shock absorber is provided as a means of transferring the lifting force from the pumping unit hanger bar to the polish rod. The shock absorber is in the form of a tubular body having an open top and a closed bottom. The bottom has an opening therein which slidably receives the polish rod. The lower end of the body rests on the pumping unit hanger bar. The tubular body provides an annular area between the interior of the body wall and the exterior of the polish rod. Positioned in this annular area are a plurality of elastomeric discs, each of which has an axial opening therein receiving the polish rod. Each disc is somewhat of doughnut shape and is thicker adjacent the periphery and of decreased thickness towards the axial opening, the decreased thickness providing annular recesses in the top and bottom of each disc. Each disc has a plurality of secondary openings through the thickest portion, the axis of the secondary opening being spaced from and parallel to the axis of the axial opening. The secondary openings are spaced from each other in equal angular relationship and arranged so that when the discs are stacked on top of each other within the shock absorber body they are arranged so that they are out of register and are thereby closed at each end by the exterior surface of adjacent discs. Thereby, each secondary opening provides a closed air space. A circular top plate having an axial opening therethrough is received on the polish rod and has a diameter slightly less than internal diameter of the body. The lower surface of the disc engages the upper surface of the uppermost elastomeric member. A polish rod clamp is secured to the polish rod above and contiguous to the top plate. When the pumping unit exerts upward force on the hanger bar, the elastomeric discs compress in proportion to the total force transmitted to the polish rod, which compression contracts the volume of air space in the disc annular recesses and secondary openings so that shock absorption is obtained by both the resiliency of the disc and by compressed air.

DETAILED DESCRIPTION OF THE PREFERRED EMBODIMENT

Figure 1:
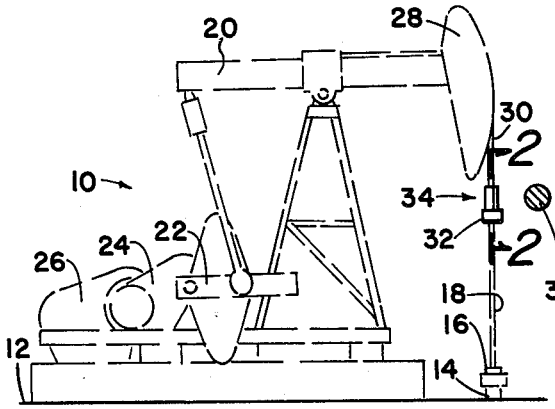
FIG. 1 is an elevational view of a typical pumping unit used for reciprocation of a polish rod connected to a string of sucker rods connected to a subterranean pump at the bottom of a well, and showing the environment in which the present invention is utilized to reduce shock of loading between the pumping unit and the polish rod.

Referring now to the drawings and first to FIG. 1, a pumping unit is indicated generally by the numeral 10. The pumping unit sits on the earth's surface 12 adjacent the upper end of a well casing 14. At the top of the casing is a stuffing box 16, and extending from the stuffing box is a polish rod 18. The polish rod is connected at its lower end to a string of sucker rods (not shown) which extend down into the well and at the lower end of the sucker rod there is a reciprocal pump (not shown). The function of the pumping unit 10 is to exert reciprocal motion to the string of sucker rods and the pump so as to lift fluid to the earth's surface.

Pumping unit 10 typically consists of a cross-beam 20 having connections at one end to a crank arm 22 which is driven by a gear train 24 which in turn is driven by rotary motion supplied by prime mover 26. The other end of the cross-beam 20 has attached to it a horsehead 28 and suspended from the horse head is a pair of spaced apart hanger cables 30. At the lower end of the hanger cables is a hanger bar 32. In the typical oil well pump which does not employ a shock absorber, the polish rod is secured to the hanger bar 32 so that upon each upward reciprocation of the horsehead 28 the polish rod 18 is lifted, thereby lifting the string of sucker rods attached to it, the pump attached to the sucker rods, and the column of fluid from the bottom of the well to the earth's surface. The apparatus described to this point is, as mentioned, a typical oil well pumping unit and forms no direct part of the invention. In essence, the present invention is directed towards a means of coupling the reciprocal force applied by the pumping unit 10 to polish rod 18 in a way so as to absorb shock load between these two components. For this purpose a shock absorber generally indicated by the numeral 34 is provided.

Figure 2:
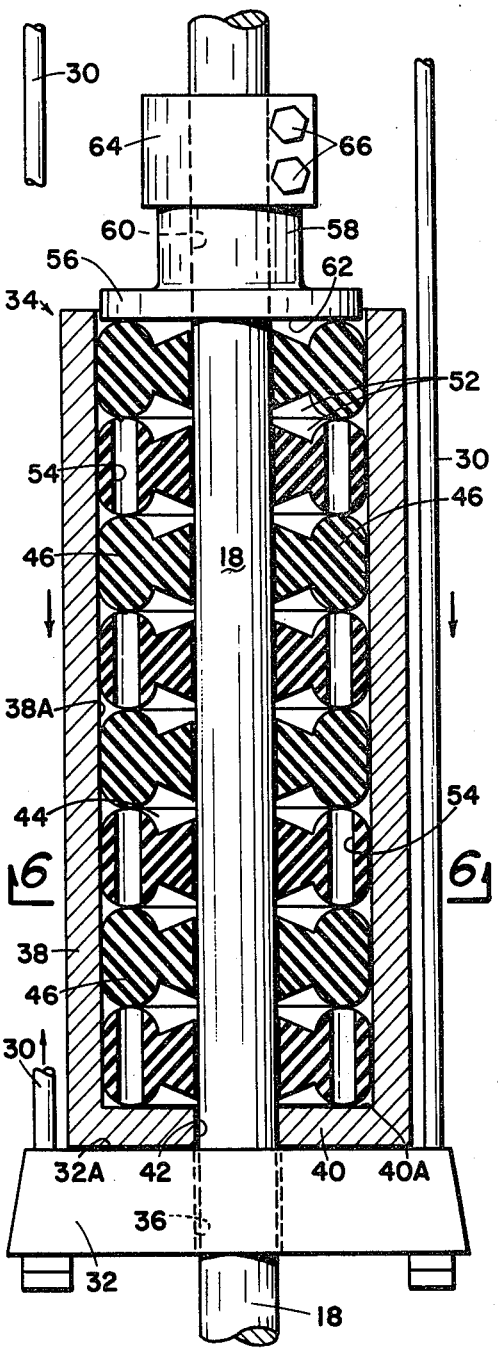
FIG. 2 is an enlarged cross-sectional view of the shock absorber of this invention as taken along the line 2—2 of FIG. 1 and showing the condition of the shock absorber when the pumping unit is on the down stroke or when minimum lifting force is applied by the pumping unit to the polish rod.
Figure 3:
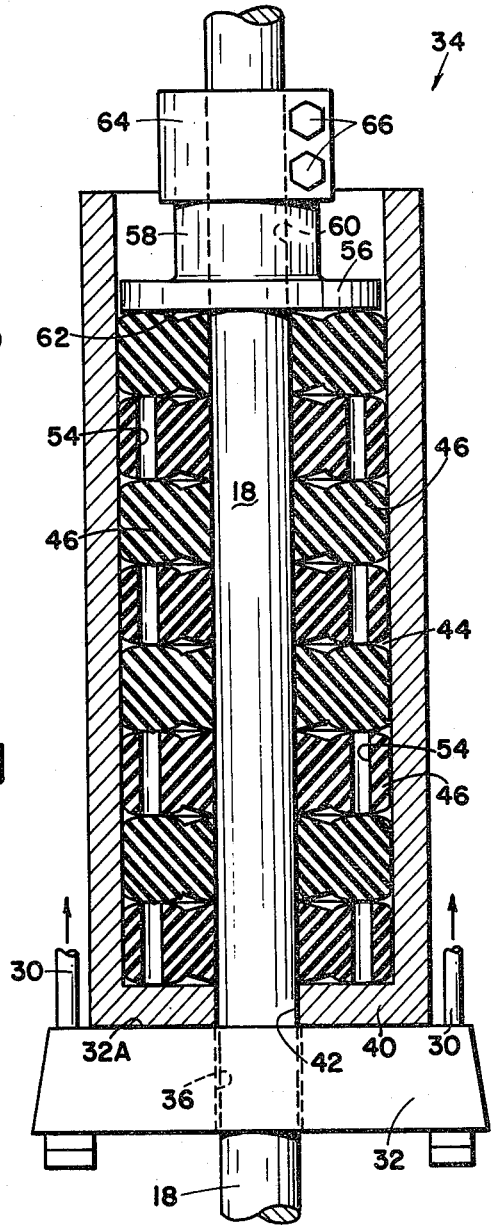
FIG. 3 is the same cross-sectional view as shown in FIG. 2, but showing the conditions when the pumping unit is on an upstroke and maximum lifting force is applied to the polish rod.

Referring to FIGS. 2 and 3, a cross-sectional view of a shock absorber 34 is illustrated. As previously stated, the hanger bar 32 has a central axial opening 36 therein which reciprocally receives the polish rod 18. Supported on the upper surface 32A is the shock absorber body 38. The shock absorber body 38 is an upright tubular member having a closed bottom 40 with an opening 42 which slidably receives the polish rod 18. Between the interior 38A of the body and the exterior of polish rod 18, an annular area 44 is provided.

Figure 4:
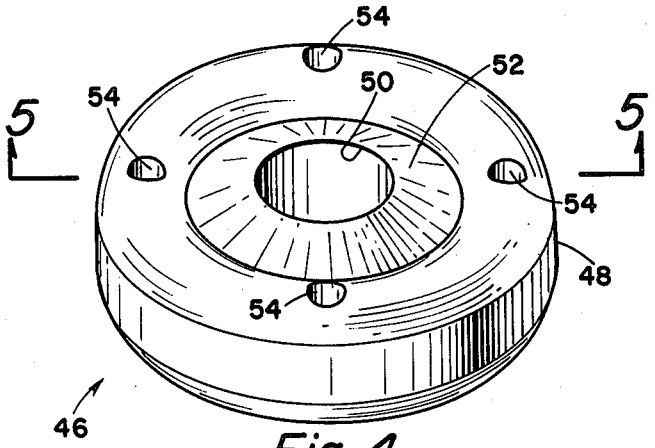
FIG. 4 is an isometric view of an elastomeric member as utilized in this invention.
Figure 6:
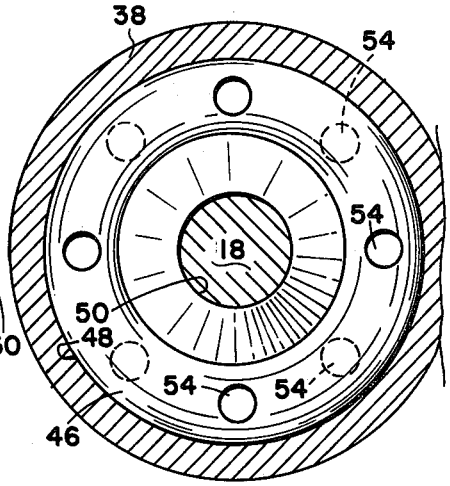
FIG. 6 is a cross-sectional view of the shock absorber as taken along the line 6—6 of FIG. 2.
Figure 5:
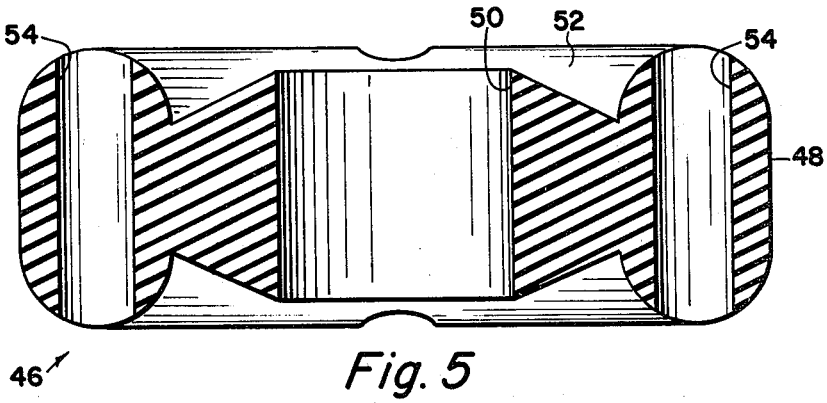
FIG. 5 is a cross-sectional view of the elastomeric member taken along the line 5—5 of FIG. 4.

Positioned in the body annular area 44 are a plurality (eight being illustrated in FIGS. 2 and 3) of elastomeric discs 46. FIGS. 4 and 6 illustrate the disc. Each of the discs 46 is of a unitary construction having a periphery 48 of a diameter slightly less than the internal diameter of the body interior 38A. Each disc has a central axial opening 50 which slidably receives the polish rod 18. The thickness of the disc is greatest at the area adjacent the periphery 50 and diminishes towards the interior of the disc but then again increases in thickness adjacent the opening 50. This configuration provides a circumferential annular recess 52 in both the top and bottom surface of each disc.

Each disc 46 is provided with a plurality (four being illustrated) of secondary openings 54. Each of the openings 54 is spaced equally distant from the axis of the disc and from each other, and thereby the secondary openings 54 are parallel to the axis of central opening 50.

When discs 46 are stacked within the body interior 38A around the polish rod 18, they are arranged so that the secondary openings 54 of adjacent discs are out of register, as illustrated in FIGS. 2, 3, and 6. The purpose of this arrangement is to provide an air seal at the top and bottom of each of the secondary openings 54 for increased air cushion as will be described subsequently.

Referring to FIGS. 3 and 4 again, positioned at the top of the shock absorber is a circular top plate 56 which has a reduced diameter cylindrical upwardly extending portion 58. The top plate 56 has an axial opening 60 which receives the polish rod 18. The planar bottom surface 62 of the top plate engages the upper surface of the uppermost disc 46.

Attached to the polish rod 18 at the upper end of the reduced diameter extention 58 of the top plate 56 is a polish rod clamp 64. Clamp 64 securely engages the polish rod 18 such as by means of bolts 66 and serves to couple the force imparted by top plate 56 to the polish rod 18.

OPERATION

When the pumping unit is on a down stroke, such as by movement of the horsehead 28 at the end of cross-beam 20 in a downward direction, lifting force imparted by the pumping unit to polish rod 18 is at its lowest level. The elastomeric discs 46 expand and the shock absorber will have a cross-sectional appearance such as shown in FIG. 2.

When the pumping unit starts its upward motion so that the horsehead 22 rises pulling hanger cables 30 and thereby the hanger bar 32 upwardly, the entire weight of the string of sucker rods, the pump attached to the end of the sucker rods, and the column of fluid being lifted by the pump are imparted to polish rod 18. This additional force is exerted downwardly by polish rod clamp 64 and top plate 62 to the elastomeric discs 46; resulting in the discs being compressed as shown in FIG. 3. In addition to compression of the discs which distorts the discs so that their total height is reduced, the air which is trapped in the annular recesses 52 between adjacent discs is compressed. In like manner, the height of secondary openings 54 is reduced, compressing the air in the openings. In this manner, the compression of air caused by the reduction in height of the discs provides an air cushion which works in conjunction with the compression of the elastomeric members themselves to produce a greatly improved shock absorbing effect. The discs are so designed that their contiguous surfaces form air seals.

The above and below adjacent discs form a seal of the annular area 54 of the top and bottom of each disc, providing closed annular recesses 52 between the discs. This air cushion effect is achieved without any components other than the configuration of the discs themselves, plus the upper surface 40A of the body bottom 40 and the lower surface 62 of the top plate 56. The air cushion augments the resiliency of the discs and provides a shock absorber having great effectiveness in reducing the shock load which is transmitted between the pumping unit and the polish rod and correspondingly between the polish rod and the pumping unit. Thus, the shock absorber provides means of imparting the lifting force from the pumping unit to the polish rod in a manner to substantially reduce the shock load on the equipment, thereby decreasing the chance of equipment damage and increasing the life of the pumping equipment.

While the dimensions of the shock absorbers may vary, typical dimensions are as follows: the diameter of disc 46 equals 12.7 cm; the interior height of the body 38 may vary from approximately 20 to 35 cm; the diameter of polish rod 18 and therefore the diameter of opening 50 in the discs, 3.81 cm; and the diameter of secondary openings 54 equals 1.1 cm. It has been found that to achieve good air cushioning effect, the total cross-sectional area of the secondary openings 54 compared to the cross-sectional area of a disc 46 should be a ratio of at least about 3%.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A shock absorber for use with an oil well pumping unit having a horizontal hanger bar suspended by cables, the hanger bar being vertically reciprocated by the pumping unit, and a vertical polish rod having the lower end secured to a string of sucker rods for actuation of a pump in a well borehole, the hanger bar having an opening therein slidably receiving the polish rod, the shock absorber providing means of transferring lifting force from the hanger bar to the polish rod, comprising:

a tubular body having an open top and a closed bottom, the bottom having an opening therein slidably receiving the polish rod concentrically of the body tubular axis, the lower end of the body resting on said hanger bar, the body providing an annular area between the interior of the body wall and the exterior of the polished rod;

a plurality of elastomeric discs received in said body, each disc having a diameter slightly less than the interior diameter of the body, and each having an axial opening therein receiving the polish rod, each disc having an annular upper and lower recess intermediate the disc axial opening and its periphery whereby the thickness of each disc is greater adjacent the axial opening and the periphery and of decreased thickness intermediate the axial opening and periphery, the recesses providing annular closed trapped air spaces between adjacent discs, and each disc having a plurality of secondary openings therethrough, the axii of which are spaced from and parallel the axis of the axial opening, the secondary openings being spaced from each other in equal angular relationship, the secondary openings extending through each disc in the area of maximum disc thickness adjacent the disc periphery, the discs being arranged so that the secondary openings are out of register and are thereby closed at each end by the exterior surfaces of the adjacent discs and whereby each secondary opening provides a closed air space;

a circular top plate having an axial opening therein receiving the polish rod, having a diameter slightly less than the internal diameter of the body and having a lower surface engaging the upper surface of the uppermost elastomeric disc; and a polish rod clamp secured to the polish rod above and contiguous to said top plate, whereby when the pumping unit exerts upward force on the hanger bar the elastomeric discs compress in proportion to the total force transmitted to the polish rod, which compression constricts the volume of air spaces in the disc annular recesses and secondary openings whereby shock absorption is obtained by both the resiliency of the discs and by compressed air.

2. A shock absorber according to claim 1 wherein the total cross-sectional area of the secondary openings measured in a plane perpendicular the axis of the central opening of each disc, is equal to at least about 3% of the total cross-sectional area of the disc measured in the same plane.

* * * * *